US008764145B2

(12) United States Patent
Moriai et al.

(10) Patent No.: US 8,764,145 B2
(45) Date of Patent: Jul. 1, 2014

(54) INKJET RECORDING APPARATUS

(75) Inventors: Takuya Moriai, Chiryu (JP); Nobuhiro Harada, Hitachi (JP); Takashi Kawano, Tokai (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 20 days.

(21) Appl. No.: 13/562,420

(22) Filed: Jul. 31, 2012

(65) Prior Publication Data

US 2013/0044149 A1 Feb. 21, 2013

(30) Foreign Application Priority Data

Aug. 19, 2011 (JP) ..... 2011-179480

(51) Int. Cl.

| | |
|---|---|
| ***B41J 29/38*** | (2006.01) |
| ***B41J 2/09*** | (2006.01) |
| ***B41J 2/085*** | (2006.01) |
| *B41J 2/02* | (2006.01) |
| *B41J 2/03* | (2006.01) |

(52) U.S. Cl.

CPC .. *B41J 2/085* (2013.01); *B41J 2/09* (2013.01); *B41J 2002/022* (2013.01); *B41J 2002/033* (2013.01)

USPC ..... 347/10; 347/77

(58) Field of Classification Search

CPC ..... B41J 2/095; B41J 2/105; B41J 2002/022; B41J 2002/033; B41J 2/09; B41J 2/03

USPC ..... 347/9, 10, 55, 74–77

See application file for complete search history.

(56) References Cited

U.S. PATENT DOCUMENTS

| | | | | |
|---|---|---|---|---|
| 7,837,307 | B2 * | 11/2010 | Schmitt | 347/77 |
| 8,136,900 | B2 * | 3/2012 | Iwasaki et al. | 347/5 |
| 2010/0073411 | A1 * | 3/2010 | Moriai et al. | 347/9 |

FOREIGN PATENT DOCUMENTS

| | | |
|---|---|---|
| JP | 2011-46139 | 3/2011 |

* cited by examiner

*Primary Examiner* — An Do

(74) *Attorney, Agent, or Firm* — Antonelli, Terry, Stout & Kraus, LLP.

(57) ABSTRACT

An inkjet recording apparatus includes an ink particle generation unit that makes a pressurized ink injected from a nozzle into particles, a charging unit that electrically charges the ink particle of those subjected to particulation, which corresponds to a dot to be printed, a polarizing unit that polarizes the electrically charged ink particle in a polarizing electric field, a collection unit that allows a gutter to collect the ink particle corresponding to the dot that is not printed, and a character forming unit that forms a character as a dot matrix on a printing object. A phase detection charging signal is applied to the ink particle that is not used for printing when forming the dot matrix character so as to detect an optimum charging timing in a process of forming the dot matrix character.

5 Claims, 8 Drawing Sheets

INKJET RECORDING APPARATUS

CLAIM OF PRIORITY

The present application claims priority from Japanese Patent Application JP 2011-179480 filed on Aug. 19, 2011, the content of which is hereby incorporated by reference into this application.

BACKGROUND

The present invention relates to an inkjet recording apparatus, and more particularly, to an inkjet recording apparatus for printing on a long product such as a cable.

An inkjet recording apparatus is configured to print by subjecting an ink injected from a nozzle to particulation at a constant cycle, and performing electrical charging and polarization at an optimum timing in the particulation in accordance with print information.

Generally, as disclosed in Patent Document 1 (JP-A No. 2011-46139), the lag in timing for charging of the ink particle may deteriorate printing quality. For the purpose of detecting the optimum timing for charging, the particulation cycle is divided into N phases, and charging is performed while shifting the phase by 1/N while preventing polarization of the ink particle so as to detect the optimum charging phase based on the respective charged amounts. As the misalignment of the optimum charging phase is likely to be influenced by the change in the ink injection pressure, ambient temperature and the like, the optimum charging phase is detected during a non-printing period between printing periods.

A printing speed, that is, a high frequency printing performance is one of indicators that represent performance of the inkjet recording apparatus. There has been introduced a method for increasing the printing speed by reducing non-printing period at an interval between the printing operations. In the interval between the printing operations, the process for detection of the optimum charging phase, and calculation of the charged amount in accordance with print information charged to the ink particle is executed. The process for detection of the optimum charging phase takes up about half the time for the non-printing period between the printing operations. The aforementioned printing method only for the single printing object fails to cope with printing on a long product such as the cable, hose, and pipe.

A generally employed inkjet recording apparatus for printing on a single product executes detection of the optimum charging phase, and calculation of the charged amount in accordance with the print information charged to the ink particle in the interval between printing operations. However, the apparatus is not capable of executing printing on such a long product as the cable, hose and pipe in the optimum charged state. A charging signal of the inkjet recording apparatus will be described hereinafter.

The inkjet recording apparatus allows a charging electrode to apply two kinds of charging signals to the ink particles, that is, a printing charging signal that charges the ink particle for formation of character information to be printed, and a phase detection charging signal that charges the ink particle so as to detect the optimum charging timing.

The inkjet recording apparatus is required to apply the printing charging signal to the ink particle at the optimum charging timing constantly. If the printing charging signal is applied to the ink particle at an inappropriate charging timing, print disorder may occur. Furthermore, the optimum charging timing changes from time to time owing to a plurality of factors, for example, viscosity or temperature of the ink.

Therefore, it is necessary to detect the change in the optimum charging timing by constantly applying the phase detection charging signal to the ink particles when the printing is not performed (the printing charging signal is not generated) so as to follow-up the detected change.

A method of detecting an optimum charging timing executed by a generally employed inkjet recording apparatus will be described referring to FIGS. 6A and 6B. Referring to FIG. 6A, (a) represents a sensor signal for detection of a non-printing object, and (b) represents detection of the optimum printing timing performed by applying the phase detection charging signal which exists between the print information (printing charging signal) and the next print information (printing charging signal) to the ink particle during the non-printing period.

With the application of infinite printing with continuous print information (printing continuously performed on the surface of the long product with the length ranging from several to several tens meters, for example, the cable, hose and pipe will be referred to as the infinite printing), there is no time interval between the print information data. It is therefore impossible for the generally employed control method to apply the phase detection charging signal to the ink particle as shown in FIG. 6B, and to detect the optimum printing timing.

It is an object of the present invention to constantly detect the optimum charging timing for the infinite printing application of printing on the surface of the long product such as the cable, hose and pipe so as not to cause the print disorder.

SUMMARY OF THE INVENTION

In order to achieve the aforementioned object, the present invention provides an inkjet recording apparatus which includes an ink particle generation unit that makes a pressurized ink injected from a nozzle that is vibrated at a constant cycle into particles at a constant cycle, a charging unit that applies a charging signal in synchronization with the cycle of particulation based on character information for printing, and electrically charges an ink particle of those subjected to particulation, which corresponds to a dot to be printed, a polarizing unit that polarizes the electrically charged ink particle in a polarizing electric field, a collection unit that allows a gutter to collect the ink particle corresponding to the dot that is not printed, and a character forming unit that forms a character as a dot matrix on a printing object by relatively moving the printing object in a substantially vertical direction to the polarizing direction of the ink particle. A phase detection charging signal is applied to the ink particle that is not used for printing when forming the dot matrix character so as to detect an optimum charging timing in a process of forming the dot matrix character.

In the inkjet recording apparatus, an ink particle for character width adjustment is added outside the dot matrix character. The phase detection charging signal is applied to the ink particle for character width adjustment to detect the optimum charging timing in the process of forming the dot matrix character.

In the inkjet recording apparatus, the optimum charging timing is detected by applying a charged voltage while shifting a phase of the particulation cycle of the ink particle for character width adjustment by 1/N (N: integer), detecting a resultant charged voltage waveform, comparing the charged voltage detected by a charging timing detection circuit with a preliminarily set threshold voltage sequentially from a zero phase, and detecting the phase at which the detected charged voltage first exceeds the threshold voltage.

In the inkjet recording apparatus, a level of the phase detection charging signal applied to the ink particle for character width adjustment is set to a charged voltage level at which the particle is not capable of jumping over the gutter.

In the inkjet recording apparatus, a panel with a setting screen for setting of a print content is provided. A character height, a character width, a number of the ink particles for detection of the charging timing, the print information, and a number of printing operations continuously performed are allowed to be input and set on the setting screen of the panel.

The present invention provides an inkjet recording apparatus that allows detection of the optimum charging timing for the infinite printing application of continuous printing on the long product such as the cable, hose and pipe, while keeping potential of causing the print disorder low.

DESCRIPTION OF THE PREFERRED EMBODIMENT

Figure 1:
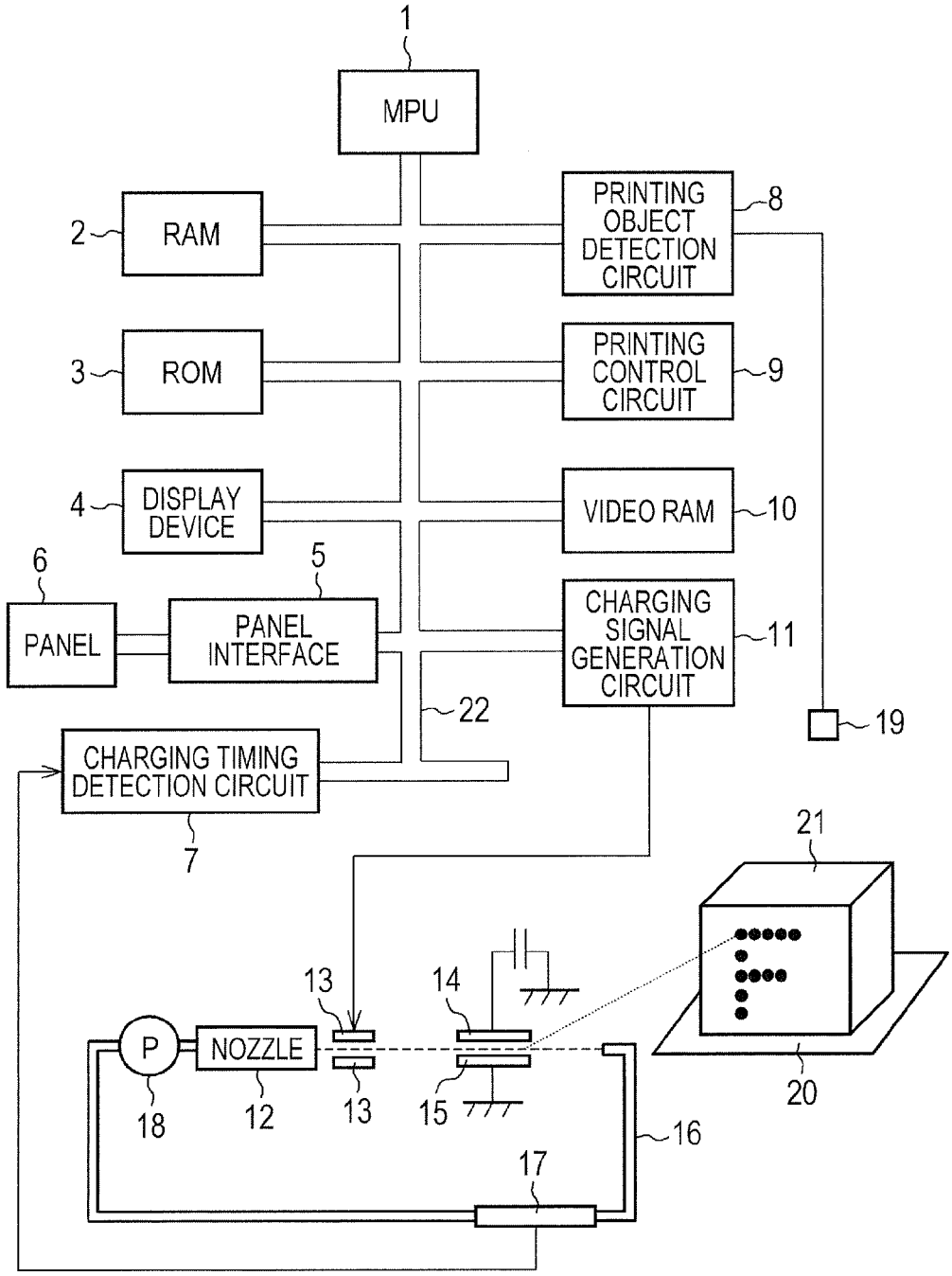
FIG. 1 is a block diagram illustrating a structure of an inkjet recording apparatus according to the present invention.

An embodiment of the present invention will be described referring to the drawings.

FIG. 1 is a block diagram illustrating a general structure of an inkjet recording apparatus according to the present invention.

Referring to FIG. 1, a reference numeral 1 denotes an MPU (Microprocessing Unit) that controls an inkjet recording apparatus as a whole, 2 denotes a rewritable RAM (Random Access Memory) that temporarily stores data, 3 denotes a ROM (Read Only Memory) that preliminarily stores required program and data, 4 denotes a display device that displays contents to be printed, 5 denotes a panel interface, and 6 denotes a panel with a screen for setting. A reference numeral 7 denotes a timing detection circuit that detects a charging timing, 8 denotes a printing object detection circuit, 9 denotes a printing control circuit that controls printing operations performed by the inkjet recording apparatus, 10 denotes a video RAM that stores video data charged to the ink particle, 11 denotes a charging signal generation circuit that converts the charging data into a printing charging signal or a phase detection charging signal, 12 denotes a nozzle that injects the ink, 13 denotes charging electrodes that charge particles of the ink injected from the nozzle in the form of particulation, 14 denotes a positive polarization electrode, 15 denotes a negative polarization electrode, 16 denotes a gutter that collects the ink particles which are not used for printing, and charged with the phase detection charging signal, 17 denotes a phase detection sensor that detects the phase detection charging signal collected by the gutter 16, 18 denotes a pump that supplies the ink collected by the gutter 16 to the nozzle again, 19 denotes a sensor that detects the printing object, 20 denotes a conveyor that carries the printing object, 21 denotes the printing object subjected to printing, and 22 denotes a bus line for data transmission.

The printing method will be described hereinafter. Upon input of the print information through the panel 6 via the panel interface 5, the MPU 1 generates charging data charged to the ink particles in accordance with the print information through the program stored in the ROM 3. The data are stored in the video RAM 10 via the bus line 22.

When the printing object detection sensor 19 detects the printing object 21, a printing start instruction is transmitted to the MPU 1 via the printing object detection circuit 8. The MPU 1 transmits the print data stored in the video RAM 10 to the charging signal generation circuit 11. The charging signal generation circuit 11 changes the received print data to the printing charging signal. The printing control circuit 9 controls the timing for transmission of the printing charging signal to the charging electrodes 13 via the bus line 22. If the printing object detection sensor 19 does not detect the printing object 21, the phase detection video data preliminarily stored in the ROM 3 are converted into the phase detection charging signal by the charging signal generation circuit 11. The converted signal is transmitted to the charging electrodes 13 likewise the printing charging signal. When the printing object detection sensor 19 detects the printing object 21, the printing charging signal is transmitted. When the printing object detection sensor 19 does not detect the printing object 21, the phase detection charging signal is transmitted to the charging electrodes 13. The ink injected from the nozzle 11 is subjected to particulation within the charging electrodes 13, charging, and polarizing during passage in the air through the electric field generated by the positive polarization electrode 14 and the negative polarization electrode 15. At that time, the ink particle is polarized in accordance with the charged amount. The highly charged ink particle has a large polarization amount, and the low charged ink particle has a small polarization amount. The ink particle with the highly charged printing charging signal is largely polarized to jump over the gutter 16 and further directed toward the printing object 21, which is adhered and printed to form a character.

Meanwhile, the ink particle that is not used for printing or charged with the phase detection charging signal with low charged amount cannot jump over the gutter 16, and will be collected thereby. It is detected by the phase detection sensor 17 as the electric signal, and transmitted to the charging timing detection circuit 7 so that the optimum charging timing is detected.

As the optimum charging timing changes from time to time, when the printing charging signal is not generated, the phase detection charging signal is constantly transmitted to the charging electrodes 13 in order to detect the optimum charging timing for following-up of the change in the optimum charging timing.

As described above, the inkjet recording apparatus detects the optimum charging timing by constantly using the phase detection charging signal, and performs printing using the printing charging signal when the printing object 21 is detected by the printing object detection sensor 19.

The printing method according to the present invention with respect to the continuous infinite printing conducted by detecting the optimum charging timing will be described.

Figure 2A:
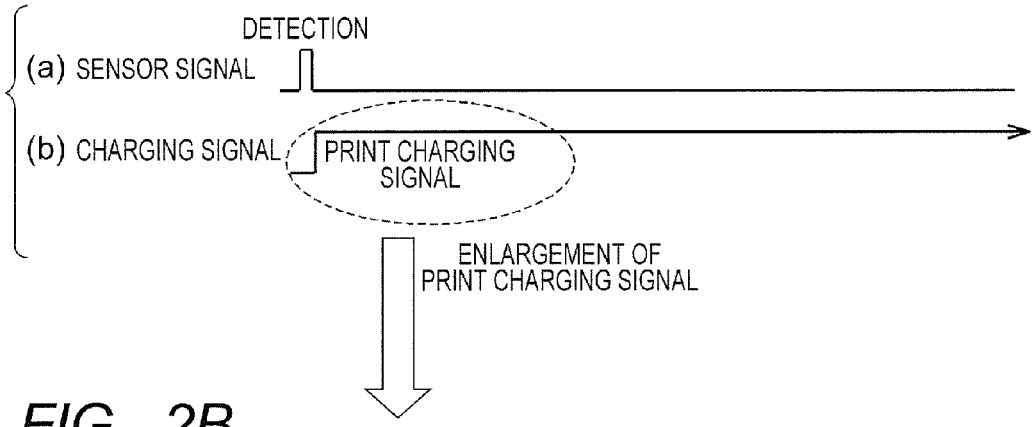
FIG. 2A is a timing chart representing a timing of printing on a printing object.
Figure 2B:
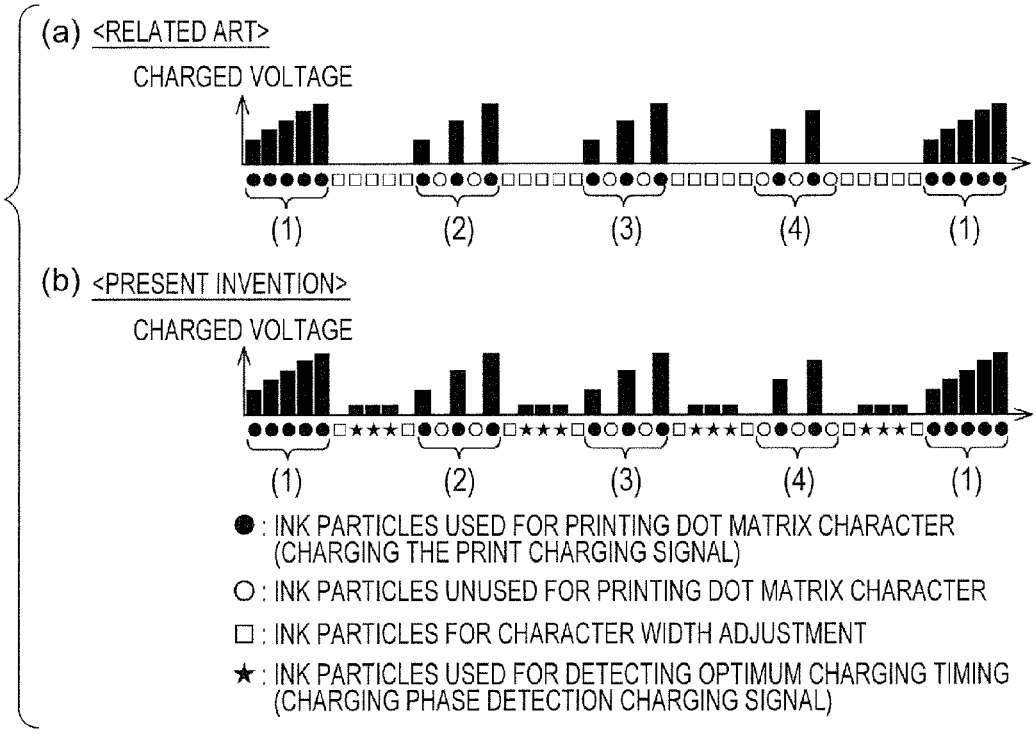
FIG. 2B represents printing charging signals according to related art and the present invention.
Figure 2C:
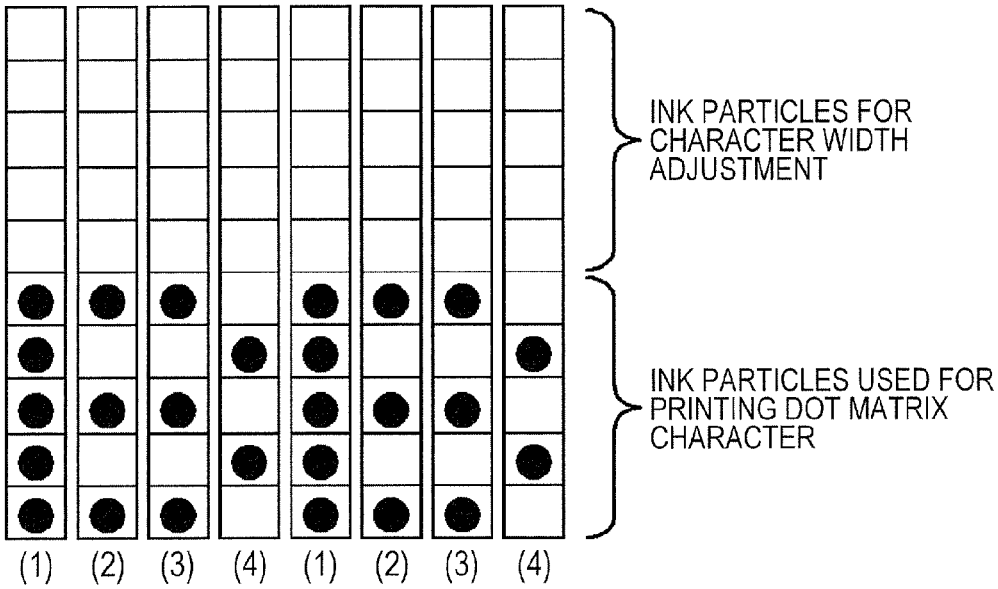
FIG. 2C represents a dot matrix of a print character "B"

FIGS. 2A, 2B and 2C represent the printing method which detects the optimum charging timing when printing the continuous characters. FIG. 2A is a timing chart indicating the timing for printing on the printing object. FIG. 2B is an enlarged view of the printing charging signal. FIG. 2C shows a dot matrix of a print character "B".

Referring to FIG. 2A, (a) denotes an output signal of the printing object detection sensor 19, and (b) denotes a charging signal of the charging signal generation circuit 11. When the detection signal is output to the printing object detection sensor 19 as (a) shows, the printing instruction is transmitted, and the printing charging signal rises as (b) shows to start printing. As the printing is continuously performed, the printing charging signal is kept in the rising state until the end of the printing operation.

Each printing pattern of the printing charging signal according to the related art and the present invention will be described referring to FIG. 2B.

FIG. 2B represents the printing pattern for continuous printing of the print characters "B" on the printing object. The print character "B" is formed as a dot matrix character as FIG. 2C shows. In other words, the character part is formed of 4 (lateral side)×5 (longitudinal side) dot matrix. The ink particles for character width adjustment are added above the character part as 5 dots for each longitudinal scan. The single longitudinal scan is formed of 5 dots for printing and 5 dots corresponding to the ink particles for character width adjustment. The number of dots for the single longitudinal scan is set to 10. FIG. 2C represents the dot matrix for continuously printing of two print characters "B". Referring to FIG. 2B, the print dot pattern of the print character "B" shown in FIG. 2C has been mapped for dot printing in chronological order.

The ink particle for character width adjustment, which is not charged is provided between the longitudinal dot scans for width adjustment of the character that is printed by the user. Referring to FIG. 2C, the ink particles for character width adjustment correspond to 5 dots. If the numerical value is set to be large, the time interval between the longitudinal scans is prolonged, resulting in increased width of the printed character. On the contrary, if the number of the ink particles for character width adjustment is set to be small, the time interval between the longitudinal scans is shortened, resulting in decreased width of the printed character. Continuous printing of the print character "B" will be described. Referring to FIG. 2C, the dot matrix character of the print character "B" is formed into 4 (lateral side)×5 (longitudinal side) dot matrix. The 5 dots of the ink particles for character width adjustment are added to each of the longitudinal scans. Referring to FIG. 2C, for the dot printing order, the dot print is performed from the lower side to the upper side of the left line (1) of the dot pattern, from the lower side to the upper side of the line (2), from the lower side to the upper side of the line (3), and finally from the lower side to the upper side of the line (4). Then printing of the single character "B" is completed.

Figure 3A:
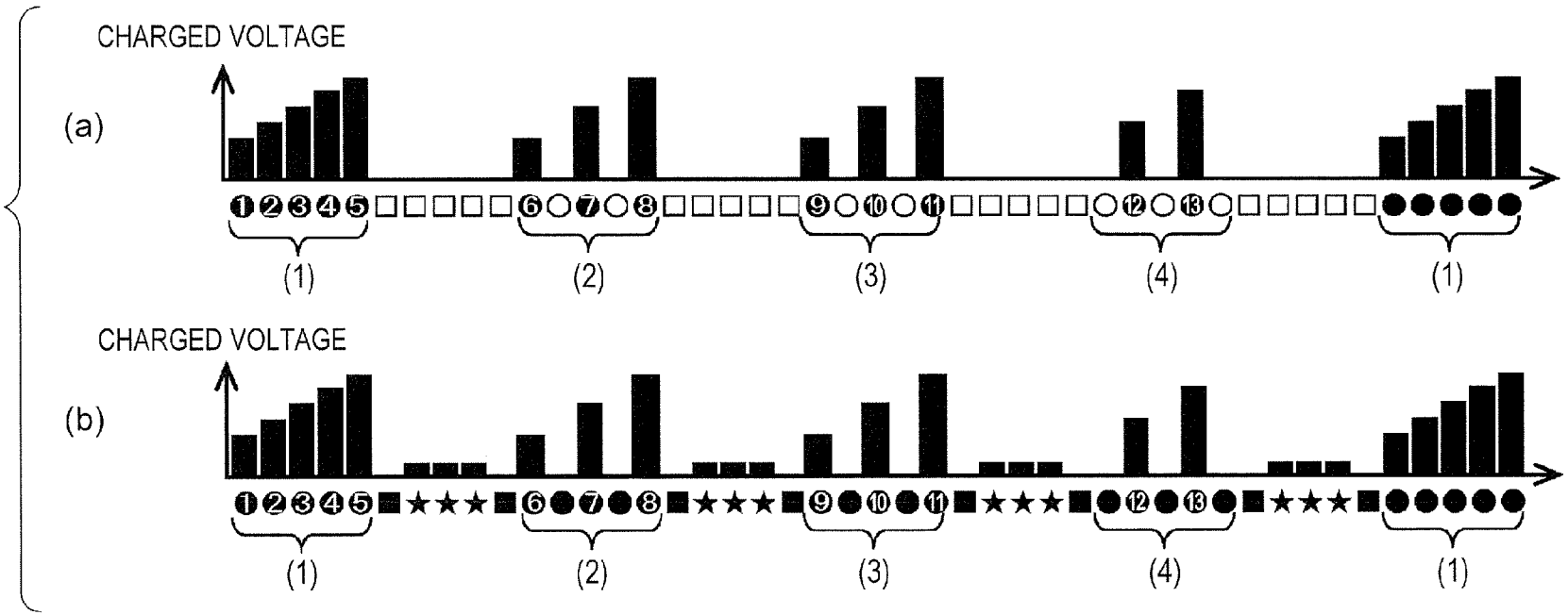
FIG. 3A represents an enlarged view of FIG. 2B.
Figure 3B:
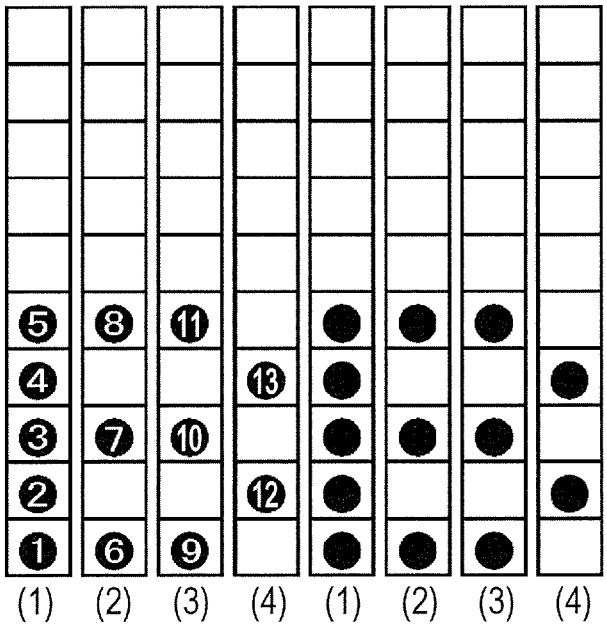
FIG. 3B is a view corresponding to FIG. 2C.

Each printing method according to related art and the present invention will be described referring to FIGS. 3A and 3B corresponding to FIGS. 2B and 2C, respectively. Referring to FIGS. 3A and 3B, the ink particle (black circle) to be printed is designated with the same number as that of the ink particle corresponding to the dot matrix.

The printing method as related art shown in FIG. 3A(a) will be described.

Referring to FIG. 3A(a), the order (1) of the ink particle corresponds to the left line (1) of the dot matrix (FIG. 3B) of the print character "B". The charged voltage of the ink particle for printing is increased stepwise in order of the black circles (1) (The number in the black circle is referred to as the black circle (1) indicating the ink particle as shown by FIGS. 3A and 3B), (2), (3), (4) and (5). As the charged voltage is increased, the polarizing voltage becomes large. The print dot is printed from the lower side to the upper side stepwise at the polarizing electrodes. This makes it possible to print the longitudinal line at the left side of the print character "B".

Then 5 dots (white square marks) of the ink particles for character width adjustment are added. As the aforementioned numerical value for the ink particles for character width adjustment is set to be large, the width of the printed character is increased. On the contrary, as it is set to be small, the character width is decreased.

The line (2) shown in FIG. 3B corresponds to the print of the center longitudinal part of the print character "B". The ink particles are directed for printing from the polarizing electrodes in order of the print ink particle as black circle (6), the non-print ink particle (the ink particle not relevant to printing), the print ink particle as black circle (7), the non-print ink particle, and the print ink particle as black circle (8).

Each of the ink particles for printing as black circles (6) and (1), (7) and (3), and (8) and (5) is at the same charged voltage.

Then 5 dots (white square marks) of the ink particles for character width adjustment are added. The line (3) as shown in FIG. 3B is printed.

The line (3) shown in FIG. 3B corresponds to the print of the center longitudinal part of the print character "B". The ink particles are directed for printing from the polarizing electrodes in order of the print ink particle as black circle (9), the non-print ink particle, and the print ink particle as black circle (10), the non-print ink particle, and the print ink particle as black circle (11). Each of the print ink particles as black circles (9) and (6) is at the same charged voltage. Each of the print ink particles as black circles (10) and (7), and (11) and (8) is at the same charged voltage, respectively.

After printing on the line (3) shown in FIG. 3B, 5 dots (white square marks) of the ink particles for character width adjustment are added to set the character width.

The line (4) shown in FIG. 3B is printed. The line (4) shown in FIG. 3B corresponds to the print of the extending part at the right side of the print character "B". The ink particles are directed from the polarizing electrodes for printing in order of the non-print ink particle, the print ink particle as black circle (12), the non-print ink particle, the print ink particle as black circle (13), and the non-print ink particle. The charged voltage of the print ink particle as black circle (12) is the same as that of the print ink particle as black circle (2) on the line (1). The charged voltage of the print ink particle as black circle (13) is the same as that of the print ink particle as black circle (4) on the line (1).

After printing on the line (4) shown in FIG. 3B, 5 dots (white square marks) of the ink particles for character width adjustment are added to set the character width.

The above-described printing method is used for printing the print character "B", and the printing is completed.

When printing of the single print character "B" is completed, subsequent printing of the print character "B" on the next line (1) is started after printing on the line (4) as shown in FIG. 3B so as to perform continuous printing of the character "B". The aforementioned process is repeatedly performed.

The printing method according to the present invention will be described referring to FIG. 3B.

The print on the left line (1) of the dot matrix of the print character "B" as shown in FIG. 3B corresponds to the black circles (1), (2), (3), (4), and (5) for the first print (1) shown in FIG. 3A(b). The charged voltage is increased stepwise in order of the ink particles as black circles (1), (2), (3), (4), and (5) for printing, and the polarizing voltage is increased as well. Polarization is performed stepwise by the polarizing electrodes so as to print from the lower side to the upper side to form the left longitudinal line of the print character "B".

After printing on the line (1) shown in FIG. 3B, 5 dots (white square marks) of the ink particles for character width adjustment are added. The phase detection charging signal is applied to the center 3 dots (black stars) of the 5 dots for detection of the optimum charging timing.

The charged voltage level of the phase detection charging signal is not increased. The charged ink particle cannot jump over the gutter 6, and collected thereby. It is detected as the electric signal by the phase detection sensor 17, and transmitted to the charging timing detection circuit for detection of the optimum charging timing.

The print on the line (2) shown in FIG. 3B corresponds to the center longitudinal part of the print character "B". The ink particles are directed from the polarizing electrodes for printing in order of the print ink particle as black circle (6), the non-print ink particle, the print ink particle as black circle (7), the non-print ink particle, and the print ink particle as black circle (8).

After printing on the line (2) shown in FIG. 3B, 5 dots (white square marks) of the ink particles for character width adjustment are added. The phase detection charging signal is applied to the center 3 dots (black stars) of the 5 dots for detection of the optimum charging timing.

The print on the line (3) shown in FIG. 3B corresponds to the center longitudinal part of the print character "B". The ink particles are directed from the polarizing electrodes for printing in order of the print ink particle as black circle (9), the non-print ink particle, the print ink particle as black circle (10), the non-print ink particle, and the print ink particle as black circle (11).

After printing on the line (3) shown in FIG. 3B, 5 dots (white square marks) of the ink particles for character width adjustment are added. The phase detection charging signal is applied to the center 3 dots (black stars) of the 5 dots for detection of the optimum charging timing.

The print on the line (4) shown in FIG. 3B corresponds to the extending part at the right side of the print character "B". The ink particles are directed from the polarizing electrodes for printing in order of the non-print ink particle, the print ink particle as black circle (12), the non-print ink particle, the print ink particle as black circle (13), and the non-print ink particle.

After printing as shown in FIG. 3B, 5 dots (white square marks) of the ink particles for character width adjustment are added. The phase detection charging signal is applied to the center 3 dots (black stars) of the 5 dots for detection of the optimum charging timing.

Each of the print ink particles as black circles (1), (6), and (9) is at the same charged voltage. Each of the print ink particles as black circles (3), (7), and (10) is at the same charged voltage. Each of the print ink particles as black circles (5), (8), and (11) is at the same charged voltage. Each of the print ink particles as black circles (2) and (12) is at the same charged voltage. Each of the print ink particles as black circles (4) and (13) has the same charged voltage.

As described above, the present invention is configured to apply the phase detection charging signal to the ink particles for character width adjustment so as to detect the optimum charging timing.

Figure 4:
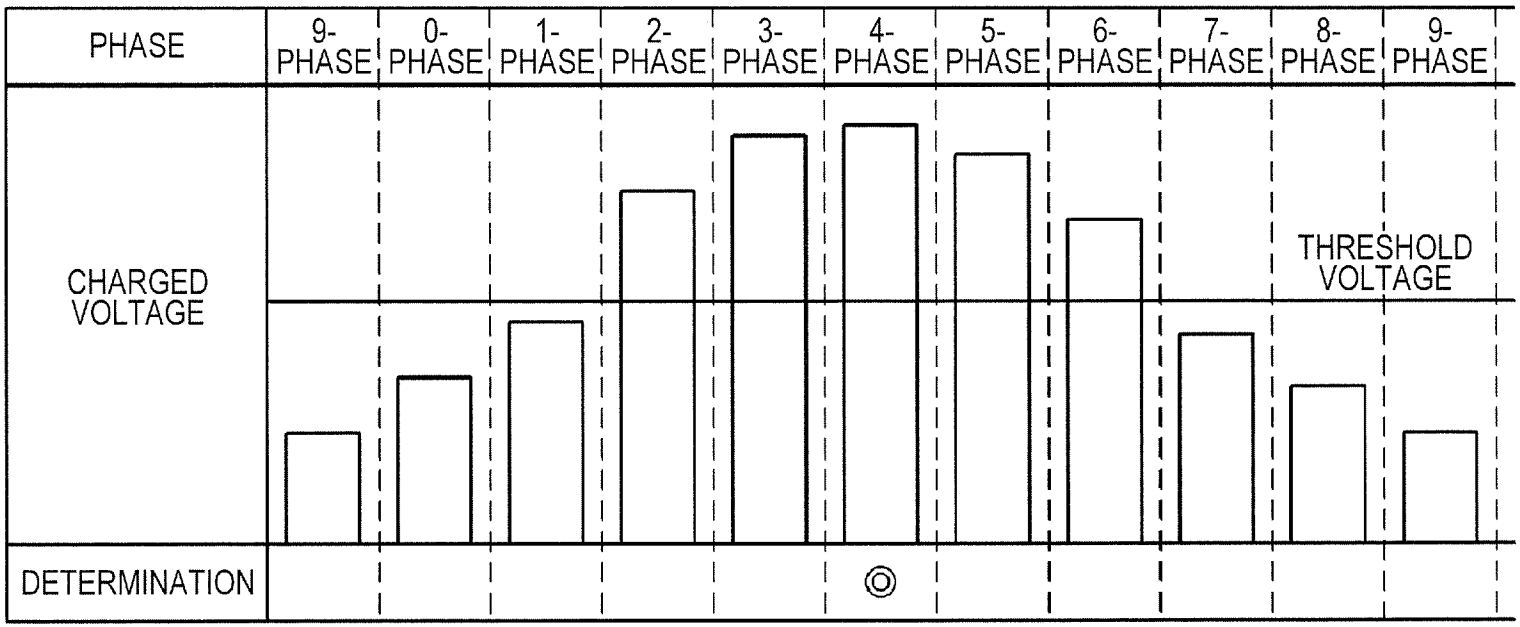
FIG. 4 is a view representing a method of detecting an optimum charging timing based on an ink particle to which a phase detection charging signal is applied.

The method of detecting the optimum charging timing by applying the phase detection charging signal to the ink particles for character width adjustment will be described referring to FIG. 4. FIG. 4 is a distribution chart of the charged voltage when the phase detection sensor 17 detects the ink particle charged with the phase detection charging signal, indicating a relationship between the waveform of the charged voltage detected by the phase detection sensor 17 and the optimum charging phase detected by the charging timing detection circuit 7.

Referring to FIG. 4, the charged voltage is applied by shifting the phase in the particulation cycle of the ink particle for character width adjustment by 1/10 so as to detect the resultant waveform of the charged voltage. The charging timing detection circuit 7 makes a comparison between the detected charged voltage and the predetermined threshold voltage in sequence from the 0-phase. The phase at which the detected charged voltage first exceeds the threshold voltage is detected to obtain the optimum charging phase. In the embodiment, the phase is set to 10. However, it is not limited to such value.

As shown in FIG. 4, the phase at the highest charged voltage detected to have exceeded the threshold voltage is determined as the optimum charging phase. Referring to FIG. 4, the 4-phase is determined as the optimum charging phase. Application of the phase detection charging signal to the ink particle for character width adjustment allows constant detection of the optimum charging timing even with the infinite printing application for continuous printing. This makes it possible to provide the inkjet recording apparatus that causes no print disorder. If the ink particle for character width adjustment is not set unlike the present invention, the phase detection charging signal cannot be applied to the ink particle for character width adjustment. Therefore, it is effective only in the presence of the ink particle for character width adjustment.

The method which allows the user to set the character width from the panel 6 will be described referring to FIGS. 5A and 5B.

Figure 5A:
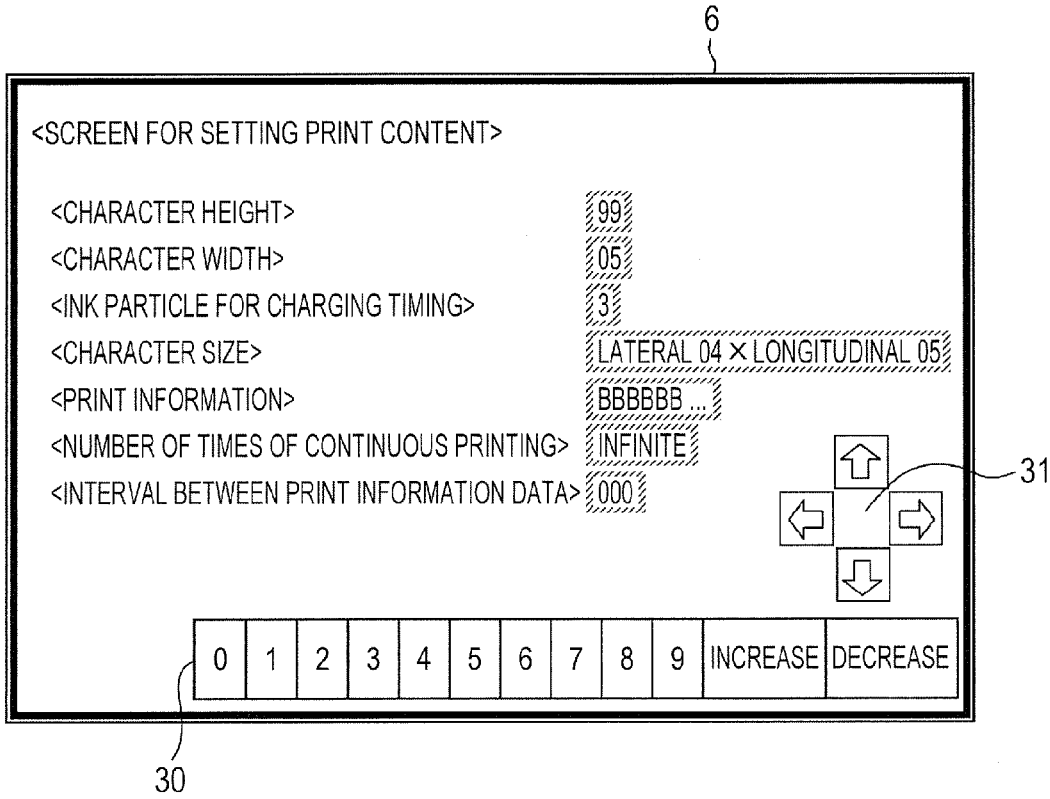
FIG. 5A is a view illustrating a screen of a panel, through which numerical values that relate to the print content are input and set.
Figure 5B:
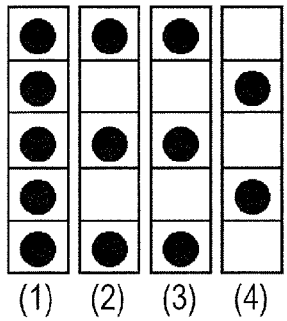
FIG. 5B represents a dot matrix character of the print character "B"
Figure 6A:
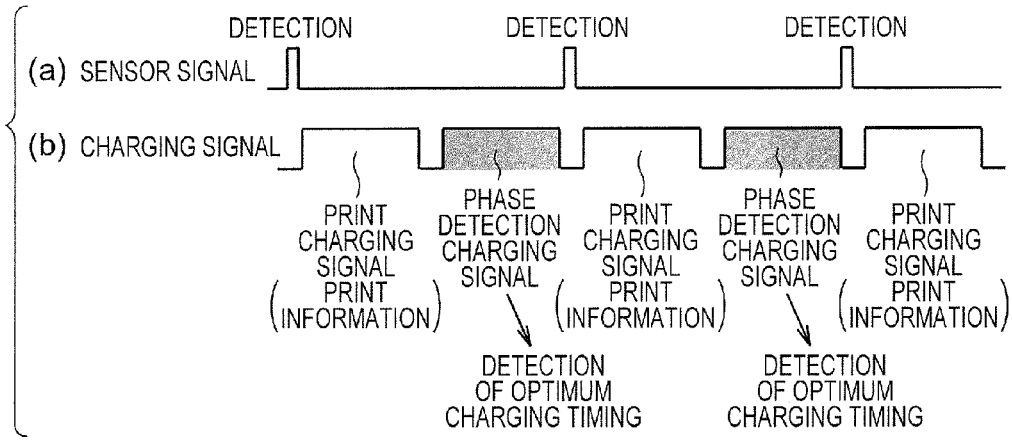
FIG. 6A shows timing charts representing the method of detecting the optimum charging timing as related art, indicating a sensor signal and a charging signal.
Figure 6B:
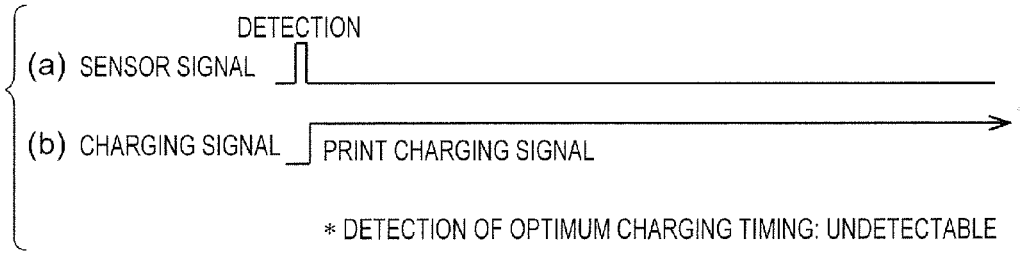
FIG. 6B shows timing charts representing the method of detecting the optimum charging timing as related art, indicating the sensor signal and the charging signal.

FIG. 5A illustrates a screen of the panel 6. FIG. 5B illustrates a dot matrix character of the print character "B". The screen for setting the print content on the panel 6 is configured to allow input of data with respect to the character height, character width, numerical value of the ink particles for charging timing, character size, print information, number of printing operations continuously performed, and interval between print information data.

The setting screen is a touch panel which allows the user to input the numerical values using numeric keys 30 at the lower right side of the screen. The inputting of the numerical value is positioned under the control of a cursor key 31 for control of an upward, downward, leftward, or rightward movement. The numerical value "99" is set for the character height as FIG. 5A shows. However, the numerical value that can be input is in the range from 0 to 99 dots. Actually, height (or size) of the character to be printed on the printing object is determined based on the distance between the inkjet recording apparatus and the printing object. The character height (or size) is determined by adjusting such distance as well.

The character width is set to 5 dots as FIG. 2C shows. As the numerical value is increased, the time interval between the longitudinal scans is prolonged, thus making the printed character large. On the contrary, as the numerical value is decreased, the time interval between the longitudinal scans is shortened, thus making the printed character width narrow. The numerical value ranging from 0 to 199 dots may be input to the section for setting.

The numerical value of the ink particle to which the phase detection charging signal is applied among those for character width adjustment for setting of the character width is input for the purpose of detecting the charging timing. The ink particle for character width adjustment is used for detection of the charging timing. It is equal to or smaller than the set value of <character width>.

The character size is set to 4 (lateral side)×5 (longitudinal side) dot matrix as shown by FIG. 5A. FIG. 5B illustrates the character "B" by adding 5 dots of the ink particles for character width adjustment above the longitudinal scans (see FIG. 2C). At the section of the print information, the character to be printed is input and set. In most of cases, alphabets and numerals are set as the print character. At the section of number of printing operations continuously performed, the number of times for printing the character is input and set. FIG. 5A shows that the printing object is long having its length ranging from several to several tens meters, for example, cable, hose or pipe, indicating that the number may be input "infinitely".

The interval between print information data denotes the interval between characters to be printed. Referring to FIG. 2C, the print character "B" is continuously printed subsequent to the print character "B" with no interval. In this case, the numerical value "000" is set to the section of the interval between print information data.

As described above, the present invention is configured to apply the phase detection charging signal to the ink particle for character width adjustment to allow constant detection of the optimum charging timing for the infinite printing application. This makes it possible to realize the inkjet recording apparatus that causes no print disorder. In the state where the ink particle for character width adjustment is not set, the present invention is not capable of applying the phase detection charging signal to the ink particle, resulting in the print disorder likewise the related art. The embodiment is effective only in the presence of the ink particle for character width adjustment.

The aforementioned embodiment provides the inkjet recording apparatus capable of detecting the optimum charging timing for infinite printing.

What is claimed is:

1. An inkjet recording apparatus comprising:

an ink particle generation unit that makes a pressurized ink injected from a nozzle that is vibrated at a constant cycle into particles at a constant cycle;

a charging unit that applies a charging signal in synchronization with the cycle of particulation based on character information for printing, and electrically charges an ink particle of those subjected to particulation, which corresponds to a dot to be printed;

a polarizing unit that polarizes the electrically charged ink particle in a polarizing electric field;

a collection unit that allows a gutter to collect the ink particle corresponding to the dot that is not printed; and a character forming unit that forms a character as a dot matrix on a printing object by relatively moving the printing object in a substantially vertical direction to the polarizing direction of the ink particle, wherein a phase detection charging signal is applied to the ink particle that is not used for printing when forming the dot matrix character so as to detect an optimum charging timing in a process of forming the dot matrix character.

2. The inkjet recording apparatus according to claim 1, wherein:

an ink particle for character width adjustment is added outside the dot matrix character; and the phase detection charging signal is applied to the ink particle for character width adjustment to detect the optimum charging timing in the process of forming the dot matrix character.

3. The inkjet recording apparatus according to claim 2, wherein the optimum charging timing is detected by applying a charged voltage while shifting a phase of the particulation cycle of the ink particle for character width adjustment by 1/N (N: integer), detecting a resultant charged voltage waveform, comparing the charged voltage detected by a charging timing detection circuit with a preliminarily set threshold voltage sequentially from a zero phase, and detecting the phase at which the detected charged voltage first exceeds the threshold voltage.

4. The inkjet recording apparatus according to claim 2, wherein a level of the phase detection charging signal applied to the ink particle for character width adjustment is set to a charged voltage level at which the particle is not capable of jumping over the gutter.

5. The inkjet recording apparatus according to claim 1, wherein:

a panel with a setting screen for setting of a print content is provided; and a character height, a character width, a number of the ink particles for detection of the charging timing, the print information, and a number of printing operations continuously performed are allowed to be input and set on the setting screen of the panel.

* * * * *